US009989276B2

(12) United States Patent
Kroetsch et al.

(10) Patent No.: US 9,989,276 B2
(45) Date of Patent: Jun. 5, 2018

(54) CONDENSATE DRAINAGE DEVICE FOR HEAT EXCHANGER

(71) Applicant: MAHLE International GmbH, Stuttgart (DE)

(72) Inventors: Karl P. Kroetsch, Williamsville, NY (US); Kenneth R. Handley, III, Lockport, NY (US); Sourav Chowdhury, Lockport, NY (US); Lawrence P. Scherer, Lockport, NY (US); Scott B. Lipa, Snyder, NY (US); David G. Schmidt, East Amherst, NY (US)

(73) Assignee: MAHLE International GmbH, Stuttgart (DE)

( * ) Notice: Subject to any disclaimer, the term of this patent is extended or adjusted under 35 U.S.C. 154(b) by 112 days.

(21) Appl. No.: 14/255,419

(22) Filed: Apr. 17, 2014

(65) Prior Publication Data

US 2015/0300680 A1 Oct. 22, 2015

(51) Int. Cl.

| | |
|---|---|
| ***F24F 13/22*** | (2006.01) |
| ***F25D 21/14*** | (2006.01) |
| ***F28F 17/00*** | (2006.01) |
| ***F28D 1/053*** | (2006.01) |
| ***F25B 39/04*** | (2006.01) |

(52) U.S. Cl.

CPC ..... *F24F 13/222* (2013.01); *F25B 39/04* (2013.01); *F25D 21/14* (2013.01); *F28D 1/05366* (2013.01); *F28F 17/005* (2013.01); *F24F 2013/227* (2013.01); *F25D 2321/146* (2013.01)

(58) Field of Classification Search

CPC ... F24F 13/222; F24F 2013/227; F25D 21/14; F25D 2321/146; F28D 1/05366; F28F 17/005

USPC ..... 62/285, 288, 290, 286, 291; 165/70

See application file for complete search history.

(56) References Cited

U.S. PATENT DOCUMENTS

| | | | | | |
|---|---|---|---|---|---|
| 1,967,518 | A * | 7/1934 | Dent | F25D 21/14 | 62/131 |
| 2,010,001 | A * | 8/1935 | Ashley | F24F 5/00 | 165/174 |
| 2,089,367 | A * | 8/1937 | Harbers | F25B 39/02 | 62/290 |
| 2,136,222 | A * | 11/1938 | Starr | A47F 3/0417 | 165/133 |
| 2,152,691 | A * | 4/1939 | Harbers | F25B 39/02 | 165/67 |
| 2,175,396 | A * | 10/1939 | Hoffman | A47F 3/0417 | 62/255 |

(Continued)

FOREIGN PATENT DOCUMENTS

| | | | | |
|---|---|---|---|---|
| CN | 102889820 A | 1/2013 | | |
| WO | 2008/072859 A1 | 6/2008 | | |
| WO | WO 2008072859 A1 * | 6/2008 | ..... | F25D 21/14 |

*Primary Examiner* — Ljiljana Ciric
*Assistant Examiner* — Kirstin Oswald
(74) *Attorney, Agent, or Firm* — Brinks Gilson & Lione

(57) ABSTRACT

A condensate drainage enhancing device is provided for an evaporator. An integrally molded plastic part snap fits around the conventional lower manifold, with rails maintained in tight engagement with the front and rear edges of the refrigerant flow tubes. These interrupt the meniscus films of columns of retained water that would otherwise form and, which instead drains down ribs that depend from the rails.

9 Claims, 5 Drawing Sheets

(56) References Cited

U.S. PATENT DOCUMENTS 2,201,268 A * 5/1940 MacMaster ..... A47F 3/0417 62/255
2,209,866 A * 7/1940 Whitney ..... F25B 39/02 62/288
2,210,725 A * 8/1940 MacMaster ..... A47F 3/0417 62/255
2,268,363 A * 12/1941 Wellington ..... F25D 21/14 62/290
2,427,200 A * 9/1947 Dreier ..... F25D 21/14 165/110
2,667,041 A * 1/1954 Henderson ..... F25B 39/02 165/135
2,728,204 A * 12/1955 Harbers ..... F25D 21/14 62/286
2,876,631 A * 3/1959 Bailey ..... F28F 1/30 165/133
3,018,639 A * 1/1962 Bailey ..... F24D 19/04 165/55
3,051,184 A * 8/1962 Gibson ..... A47L 15/0089 134/107
3,170,743 A * 2/1965 Martiniak ..... A47L 15/483 312/213
3,306,071 A * 2/1967 Holyfield ..... F24F 13/22 62/288
3,314,354 A * 4/1967 Yousoufian ..... F24F 1/01 236/13
3,367,132 A * 2/1968 Elliott ..... F24D 3/00 165/55
3,459,115 A * 8/1969 Gutermuth ..... B08B 15/00 126/299 D
3,750,418 A * 8/1973 Maudlin ..... F25B 39/02 165/181
3,763,929 A * 10/1973 Wenig ..... F28D 1/053 165/181
3,805,404 A * 4/1974 Gould ..... D06F 58/04 34/596
4,089,188 A * 5/1978 Van Laeys ..... F24F 13/22 165/181
4,410,033 A * 10/1983 Wawro ..... F24F 1/0007 165/137
4,602,486 A * 7/1986 Weinstein ..... F24F 13/22 128/205.26
4,907,420 A * 3/1990 Mahanay ..... F25D 21/14 62/285
4,941,901 A * 7/1990 Ramakrishnan ..... F24F 13/22 62/262
5,195,332 A * 3/1993 Sullivan ..... F24F 1/0007 62/285
5,211,219 A * 5/1993 Kawabata ..... F24F 1/0007 165/122
5,279,360 A * 1/1994 Hughes ..... F25B 39/02 165/111
5,341,870 A * 8/1994 Hughes ..... F25B 39/02 165/110
5,454,231 A * 10/1995 Bolton ..... F24F 1/027 312/100
5,468,186 A * 11/1995 Bolton ..... F24F 13/075 454/202
5,481,886 A * 1/1996 Hasegawa ..... F24F 13/22 165/913
6,182,745 B1 * 2/2001 Potier ..... F28F 1/32 165/134.1
6,196,015 B1 * 3/2001 Pignolo ..... F24F 1/00 62/272
6,637,232 B1 * 10/2003 Harshberger ..... F24F 1/0007 165/122
7,430,877 B2 * 10/2008 Davenport ..... F24F 13/224 62/272
7,635,019 B2 * 12/2009 Higashiyama ..... F25B 39/02 165/110
7,971,636 B2 * 7/2011 Higashiyama ..... B60H 1/00328 165/174
8,555,668 B2 * 10/2013 Lee ..... B60H 1/3233 62/285
2005/0109053 A1 * 5/2005 Eom ..... F24F 1/0007 62/285
2006/0162376 A1 * 7/2006 Higashiyama ..... F25B 39/022 62/515
2007/0169493 A1 * 7/2007 Rios ..... F24F 13/222 62/285
2008/0028788 A1 2/2008 Higashiyama
2009/0282850 A1 * 11/2009 Higashiyama ..... F25B 39/02 62/239
2013/0306280 A1 11/2013 Goodman et al.

* cited by examiner

CONDENSATE DRAINAGE DEVICE FOR HEAT EXCHANGER

TECHNICAL FIELD

This invention relates to cross-flow heat exchangers in general, and specifically to an air conditioning evaporator core in which entrained, condensed water from the ambient air blown over said evaporator is likely to become entrained in the core and partially block air flow

BACKGROUND OF THE INVENTION

Cross flow evaporators typically are mounted vertically or nearly so with parallel pairs of refrigerant flow tubes extending between substantially horizontal, upper and lower manifolds. Especially in evaporators of compact design and high capacity, the refrigerant flow tubes are closely spaced, and the lower manifold is significantly wider than the edge to edge width of the flow tubes. Ambient air with substantial relative humidity is blown across the refrigerant flow tubes, condensing thereon and draining down toward the lower manifold. Because of the close spacing of the tubes and width of the lower manifold, condensed water tends to build up in columns between the lower ends of the tubes, blocked by the lower manifold These columns rise to and dynamically maintaining a characteristic height dependent on the dimensions of the particular core in question and the humidity, forming a slightly concave meniscus film that bulges out minutely past the front and back edges of the closely spaced pairs of tube ends. These retained columns of water can block air flow sufficiently to affect the efficiency of the core.

One known and straightforward response has been to purposely stamp individual drain troughs or grooves directly into the surface of the lower manifold, between the pairs of tube ends. A typical example may be seen in U.S. Pat. No. 7,635,019, and there are numerous variations of the same basic theme. This requires dedicated dies and tools for the lower manifold, of course, and can disrupt the flow of refrigerant in the lower manifold.

SUMMARY OF THE INVENTION

The subject invention provides a separate drainage device that can be added and retrofitted to an existing evaporator of the type described, enhancing drainage and improving efficiency with no change to the basic core design.

In the preferred embodiment disclosed, a plastic molded part consisting of a pair of horizontal rails, integrally and flexibly molded by generally C shaped depending ribs to a central keel, has a free state separation slightly less than the edge to edge width of the refrigerant tubes. This allows the rails to be spread apart far enough to snap over the wider lower manifold and into tight, resilient engagement with both the front and rear edges of the tubes, at a point near the surface of the lower manifold and well below the characteristic height of the retained columns of water that would otherwise form.

In operation, as condensed water begins to form the characteristic retained columns, the meniscus film is interrupted by the tightly engaged rails and the condensed water runs down the surface of the ribs, dripping finally into a sump or simply off of the core. The edges of the ribs may be formed as semi-cylinders to enhance the drainage effect.

DESCRIPTION OF THE PREFERRED EMBODIMENT

Figure 1:
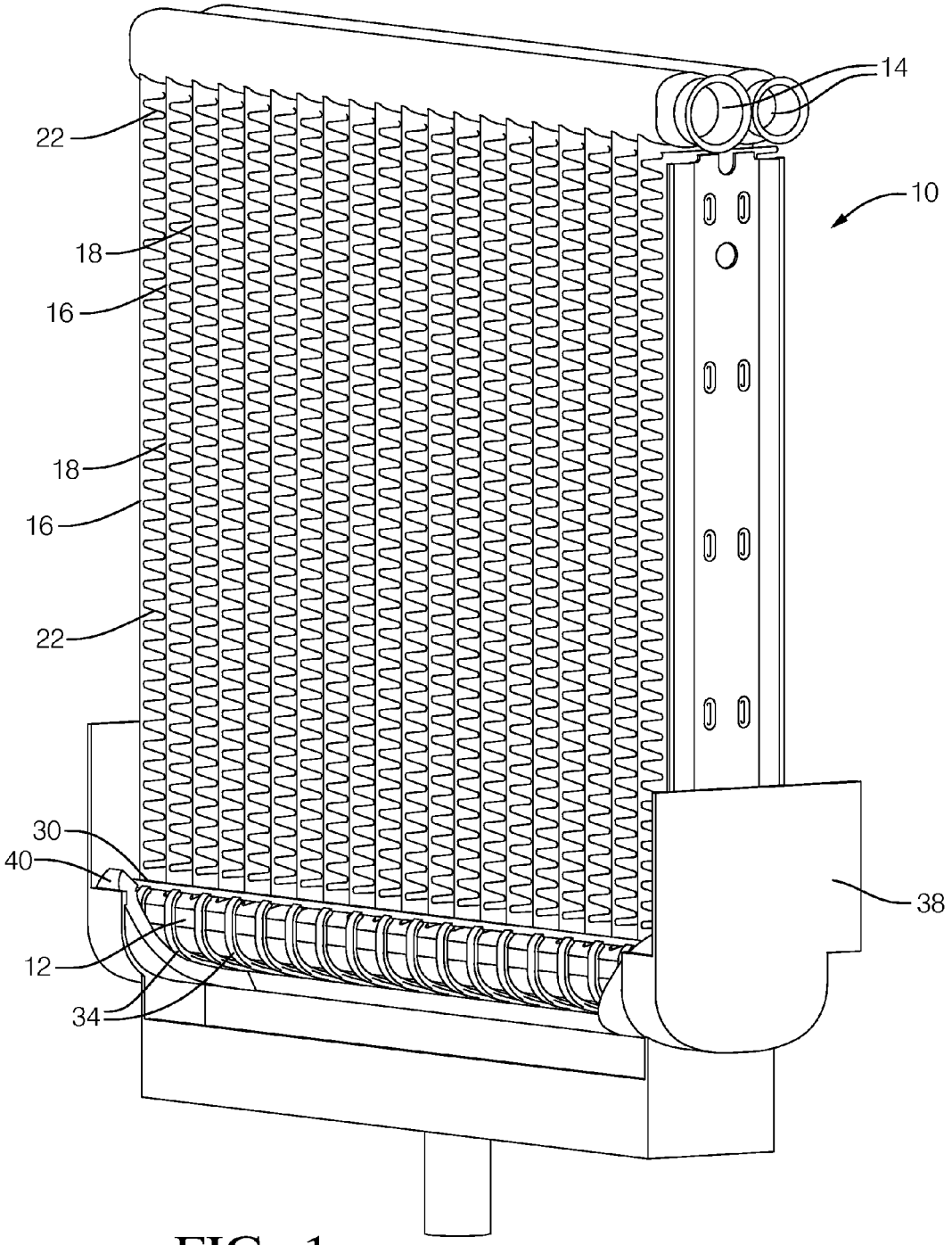
FIG. 1 is a perspective view of a preferred embodiment of the drainage device of the invention installed on an evaporator.
Figure 2:
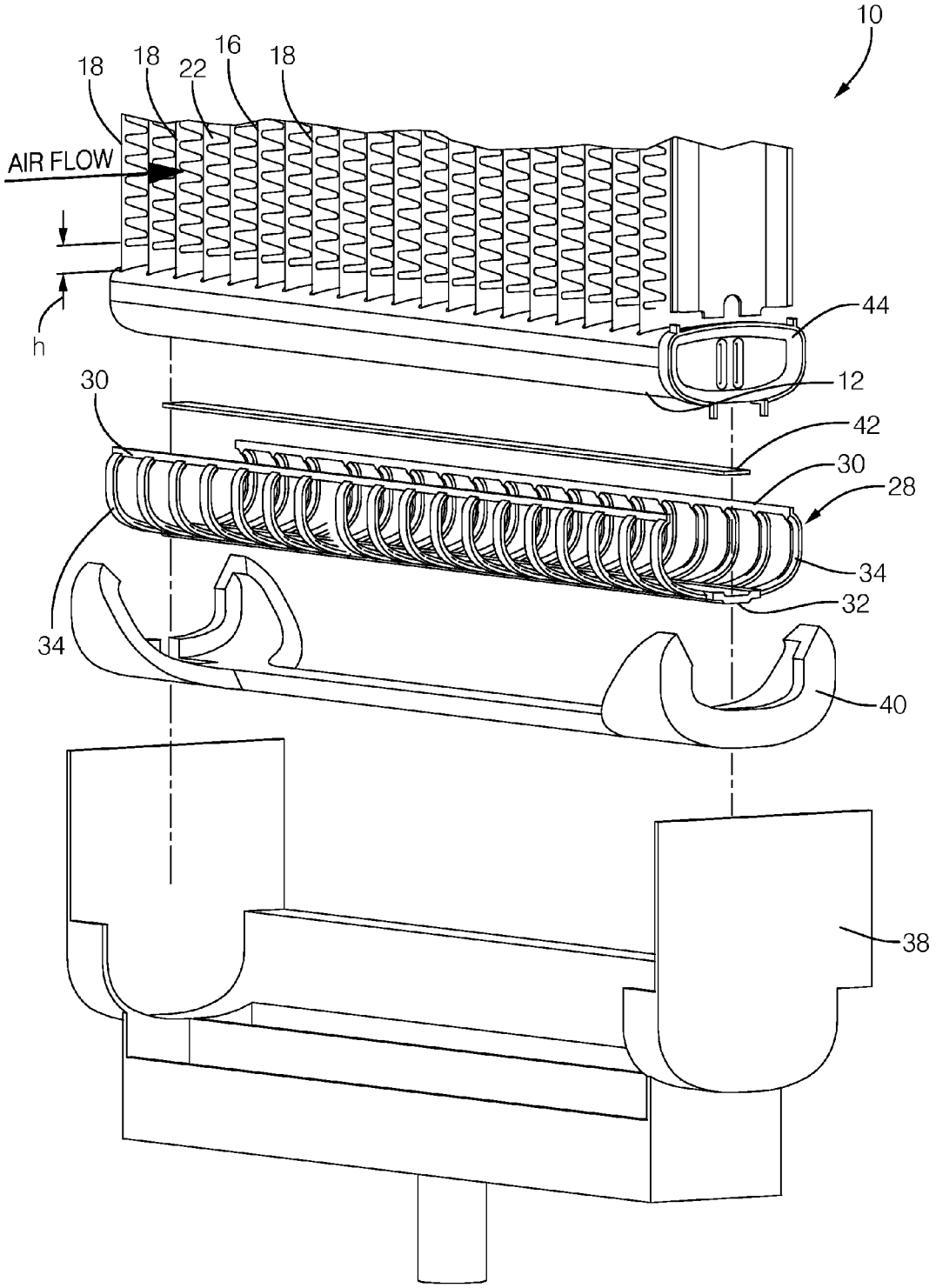
FIG. 2 is an exploded view of the evaporator and the drainage device of the invention.

Referring first to FIGS. 1 and 2, an evaporator indicated generally at 10 is a typical brazed aluminum design with a lower manifold 12, parallel upper manifolds 14, and, since it is a U flow construction, coplanar pairs of parallel, closely spaced refrigerant flow tubes 16. A single pass construction would have single flow tubes with a similar spacing, but likely greater width. Front and rear tube edges 18 and 20 define parallel front and rear core faces. The lower manifold 12 is typically significantly wider than the tubes 16, leaving a significant upper surface extending out from both the front and rear tube edges 18 and 20. Corrugated fins 22 are brazed between the tubes 16 to enhance heat transfer, but do not extend all the way down to the upper surface of lower manifold 12. The orientation shown is the orientation that evaporator 10 has in operation, substantially vertical, so that when humid ambient air is blown over the tubes in a so called cross-flow fashion, condensed water forms on the tube surfaces and drains and runs down, toward the upper surface of lower manifold 12.

Figure 4:
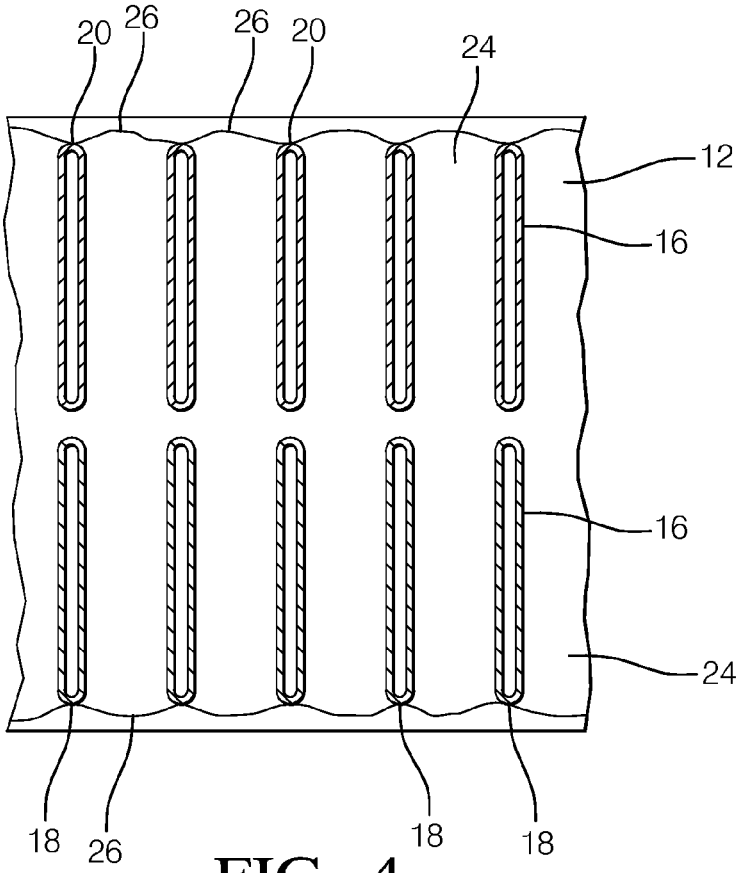
FIG. 4 is a cross section of a portion of the evaporator showing the presence of condensed and retained water pockets.

Referring next to FIGS. 1 and 4, the result of the water condensed during operation, in the absence of the subject invention, is illustrated. The combined effect of the close spacing of tubes 16, typical for a compact, high efficiency evaporator, the natural surface tension of water, and the extent of the manifold surface beyond the tube edges 18 and 20 is that condensed water forms retained columns 24 at and between the lower ends of the tubes 16, where they enter the lower manifold 12. While the upper surface of the lower manifold 12 is smooth and even downwardly curved, it presents enough resistance to drainage along its surface that the columns 24 will rise to a characteristic height h before creating enough pressure to drain down and off the edge of lower manifold 12. Water is continually condensing, so the height h is dynamically maintained, though it will rise and fall somewhat with humidity, temperature and other conditions. Another effect of the downward pressure of the columns 24 and the surface tension of the water is that outwardly bulging meniscus films 26 are formed, extending out slightly from both the front and back tube edges 18 and 20, as shown in FIG. 4.

Figure 3:
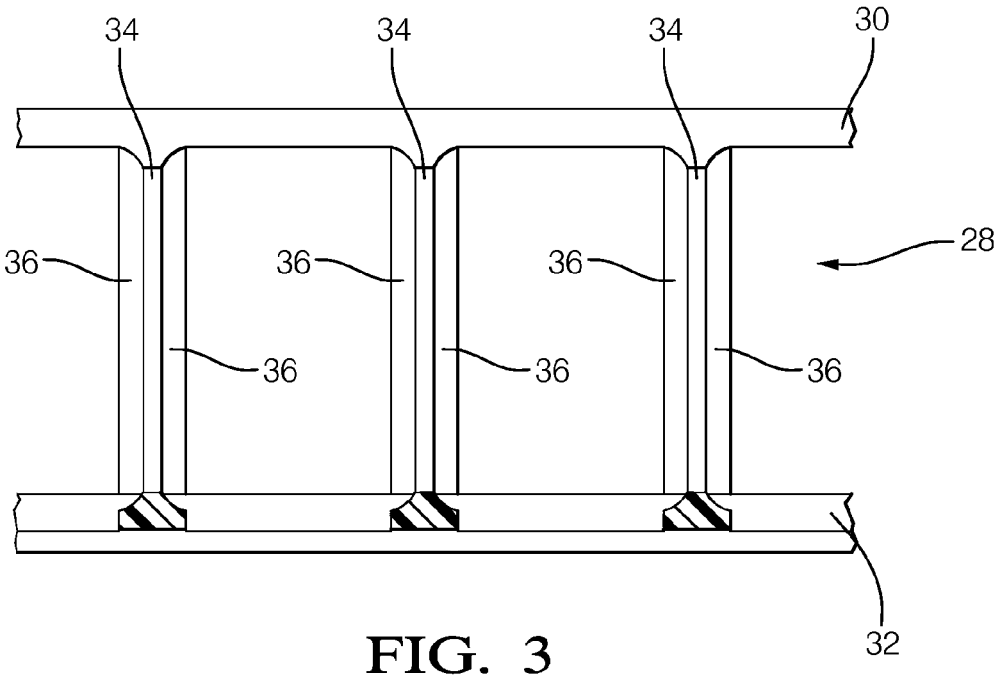
FIG. 3 is a cross section of a portion of the drainage device.

Referring next to FIGS. 2 and 3, a preferred embodiment of the drainage device of the invention is indicated generally at 28. It is an integral, molded plastic part, with a pair of parallel, straight rails 30 joined to a stiff central keel 32 by an evenly spaced plurality of curved ribs 34. As seen in FIG. 2, the free state separation of the rails 30 is just slightly less than the width measured between tube front and rear edges 18 and 20 and, substantially less that the width of lower manifold 12. As best seen in FIG. 3, the inner edges of ribs 34 are concave, specifically semi-cylindrical troughs 36, rather than sharp for a purpose described below.

Figure 5:
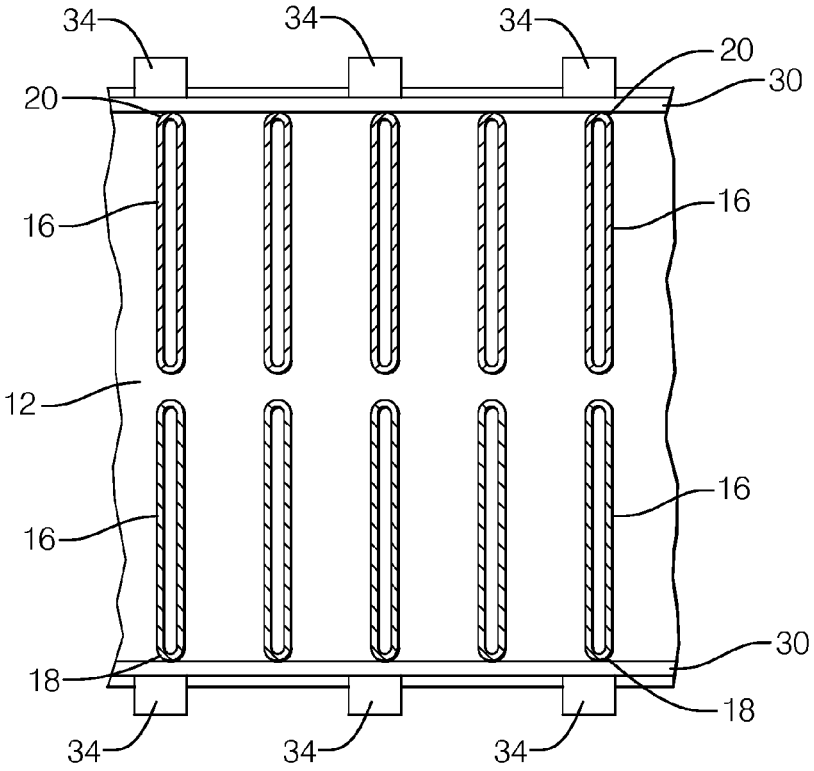
FIG. 5 is similar to FIG. 4, but showing the drainage device installed.
Figure 6:
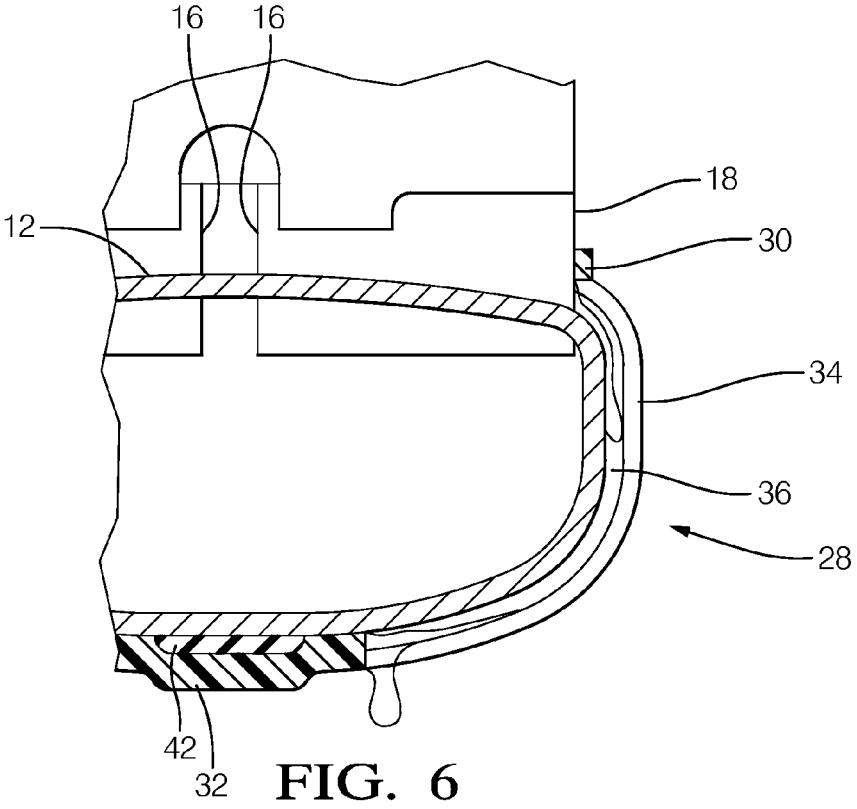
FIG. 6 is an end view of the drainage device in operation, with the manifold end cap removed.
Figure 7:
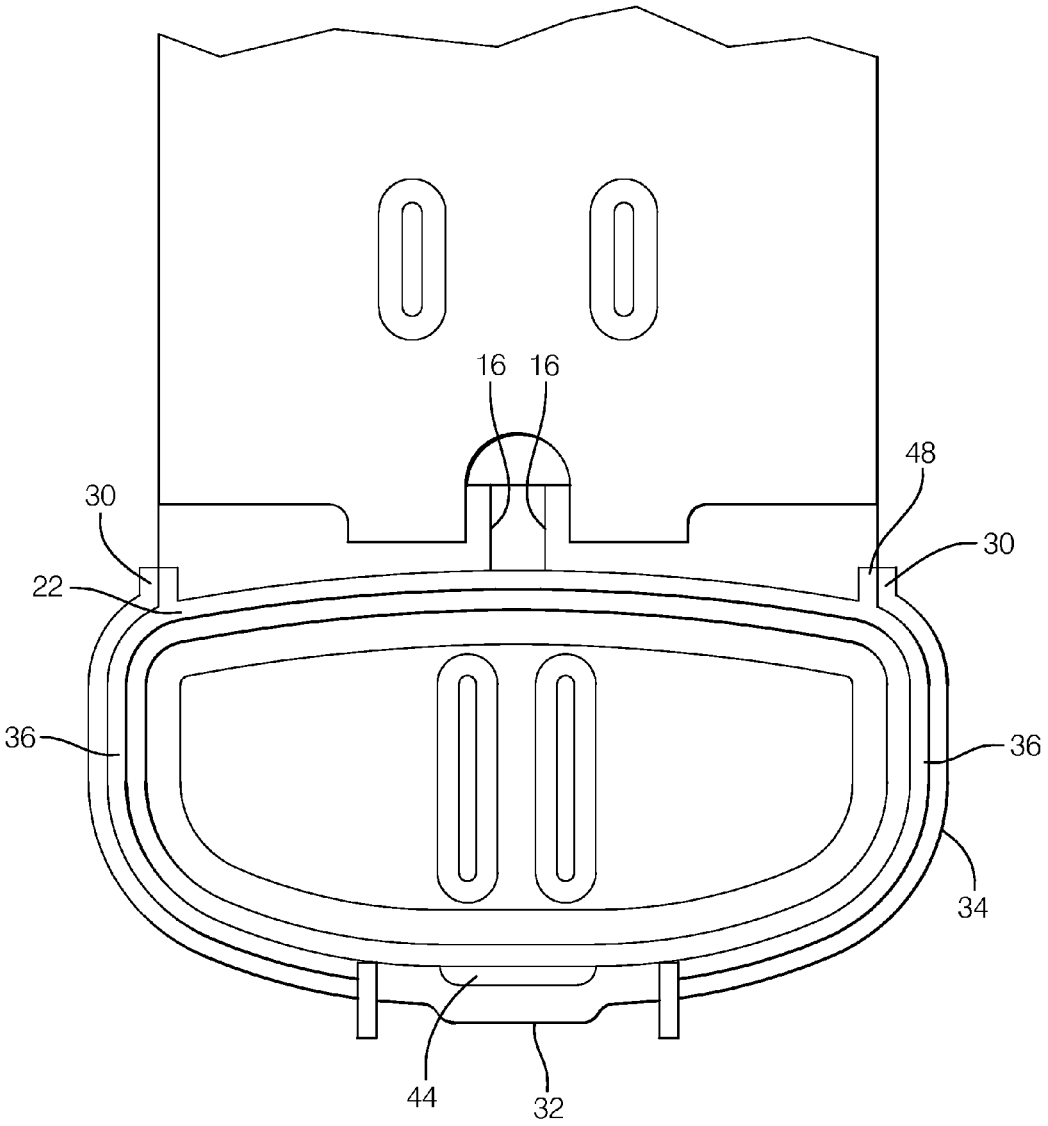
FIG. 7 is an end view of the drainage device installed.

Referring next to FIGS. 5 and 6, the flexibility of ribs 34 allows the rails 30 to be pulled apart and snapped over the width of lower manifold 12, thereby bringing the rails 30 into tight engagement with the tube front and rear edges 18 and 20, and at a location near the upper surface of lower manifold 12, well below the characteristic column height h described above. The inner surface of the ribs 34 also conforms closely to the outer surface of the lower manifold 12. As a consequence, the water column meniscus films 26 are interrupted by the rails 30 as they attempt to form and run down the ribs 34, through the channels formed by the outer surface of lower manifold 12 and the rib troughs 36, ultimately dripping off of the ribs 34 at the keel 32. This is best illustrated in FIG. 6. As a consequence, the retained water columns 24 described above are prevented from forming, and the problems of air blockage, pressure drop, and potential water "spitting" avoided.

Referring again to FIGS. 1 and 2, additional structure can be provided to work in cooperation with the drainage device 28, which fairly closely matches the profile of lower manifold 12. A sump or drip pan 38 and a foam seal 40 can cradle the drainage device 28 and lower manifold 12, preventing the blow-by of forced air. A strip seal 42 can be installed between the keel 32 and the underside of lower manifold 12 to also prevent air blow-by. The drip pan 38 can be open on the upstream air side, and closed on the downstream side, as shown, to allow forced air to blow water off of the drainage device 28 without loss from the drip pan 38. One or more end clips 44 can be added to the ends of the lower manifold 12 to confine the drainage device 28 axially, if desired.

Variations in the preferred embodiment 28 could be made. A single rail 30, best situated on the air downstream side and in contact with just the tube rear edges 20, could, in cooperation with the depending ribs 34, provide for condensate drainage, but some other means of installation would have to be provided to maintain the device 28 in position. "Rail" as used here could encompass an aligned series of separate pieces, each of which touched and intruded into the entrained water columns enough to enhance the drainage as described. The two rails 30 provide more drainage paths and also allow for the self-retention after installation. Differently shaped ribs 34, so long as they depended, could provide drainage paths, but the curved shaped matches well to the shape of manifold 12, as noted, providing effective drainage paths. Localized, inwardly protruding features on rails 30 could be provided between the pairs of adjacent tubes 16, to aid breaking the meniscus films 26. It will be understood that the invention could be used with any heat exchanger in which a cold fluid flow tube has humid air passing over it to cause sufficient retained condensation to necessitate enhanced drainage.

The invention claimed is:

1. A cross flow heat exchanger comprising:

a plurality of horizontally spaced, parallel and vertically oriented tubes configured to provide a fluid path for an inner fluid flowing at a temperature at which entrained water condenses out of air flowing across and between the tubes, the tubes having front edges being coplanar and rear edges being coplanar, a lower horizontal manifold, into which the front edges and rear edges enter, the lower manifold oriented along a manifold axis with a tube to tube spacing causing condensed water to become entrapped in condensate columns of a height between the tubes with meniscus films on the lower manifold, presented to the front and rear tube edges, and a condensate drainage enhancing device having a horizontal first rail extending along the manifold axis at an uppermost height of the condensate drainage enhancing device and contacting the front edges of the tubes at a location below the height of the condensate columns and contacting the meniscus films, and, a plurality of first drainage ribs depending below and downward from the first rail, evenly spaced apart from each other along the manifold axis by empty gaps, and oriented to extend away from the front edges to provide a drainage path for condensed water out of the columns, a second horizontal rail at the uppermost height of the condensate drainage enhancing device, extending along the manifold axis and contacting the rear edges of the tubes at a location below the height of the condensate columns and having second drainage ribs depending below and downward from the second rail that are oriented to extend away from the rear edges, wherein the first drainage ribs describe a curved path originating from the first rail outward in a direction away from the second drainage ribs.

2. The cross flow heat exchanger according to claim 1, wherein the first drainage ribs that describe the curved path originating from the first rail and extending first outward in the direction away from the axis and from the second drainage ribs, then extend downward, and finally inward toward the second drainage ribs.

3. The cross flow heat exchanger according to claim 1, further comprising a second horizontal rail, extending at the uppermost height along the axis on a second side opposite the first side parallel to the first rail, the second horizontal rail having second drainage ribs depending downward therefrom and below the second horizontal rail, wherein the second drainage ribs describe a curved path, originating from the second rail, first outward in a direction away from the first drainage ribs, then downward, and finally inward toward the first drainage ribs.

4. The cross flow heat exchanger according to claim 3, in which the first and second drainage ribs depending from the first and second rails are joined at their lower ends to a central keel running parallel to and beneath the axis and spaced from the first and second rails by the first and second drainage ribs.

5. The cross flow heat exchanger according to claim 4, in which the lower manifold that has a width greater than the distance between the first and second rails when the condensate drainage enhancing device is not attached to the tubes of the heat exchanger, and in which the drainage ribs are flexibly joined to the keel with a free state separation between the first drainage ribs and the second drainage ribs when the drainage device is not attached to the tubes of the heat exchanger, which is somewhat less than in an installed position so that the horizontal rails may snap fit over the lower manifold.

6. The cross flow heat exchanger according to claim 5, in which at least one edge of the first or second drainage ribs is concave in cross section to enhance drainage.

7. The cross flow heat exchanger according to claim 4, in which at least one edge of the first or second drainage ribs is concave in cross section to enhance drainage.

8. The cross flow heat exchanger according to claim 3, in which at least one edge of the first or second drainage ribs is concave in cross section to enhance drainage.

9. The cross flow heat exchanger according to claim 1, in which at least one edge of the first and second drainage ribs is concave in cross section to enhance drainage.

* * * * *